US011850653B2

(12) United States Patent
Yoshida et al.

(10) Patent No.: US 11,850,653 B2
(45) Date of Patent: Dec. 26, 2023

(54) BINDING MACHINE

(71) Applicant: MAX CO., LTD., Tokyo (JP)

(72) Inventors: Yusuke Yoshida, Tokyo (JP); Kouichirou Morimura, Tokyo (JP); Ichiro Kusakari, Tokyo (JP)

(73) Assignee: MAX CO., LTD., Tokyo (JP)

( * ) Notice: Subject to any disclaimer, the term of this patent is extended or adjusted under 35 U.S.C. 154(b) by 67 days.

(21) Appl. No.: 17/172,522

(22) Filed: Feb. 10, 2021

(65) Prior Publication Data

US 2021/0245229 A1 Aug. 12, 2021

(30) Foreign Application Priority Data

Feb. 10, 2020 (JP) ..... 2020-021026

(51) Int. Cl.

| | |
|---|---|
| ***B21F 15/04*** | (2006.01) |
| ***B21F 7/00*** | (2006.01) |
| ***B21F 11/00*** | (2006.01) |
| ***E04G 21/02*** | (2006.01) |
| ***E04G 21/12*** | (2006.01) |

(52) U.S. Cl.

CPC ..... *B21F 15/04* (2013.01); *B21F 7/00* (2013.01); *B21F 11/00* (2013.01); *E04G 21/123* (2013.01)

(58) Field of Classification Search

CPC ..... B21F 15/00; B21F 15/02; B21F 15/04; B65B 13/22; B65B 13/28; B65B 13/285; B65B 13/025; B25B 25/00; E04G 21/123

See application file for complete search history.

(56) References Cited

U.S. PATENT DOCUMENTS

| | | | | |
|---|---|---|---|---|
| 5,279,336 | A | 1/1994 | Kusakari et al. | |
| 5,682,927 | A | 11/1997 | Takahashi et al. | |
| 5,831,404 | A | 11/1998 | Ishii | |
| 8,198,839 | B2 * | 6/2012 | Katou | B25F 5/02 388/937 |
| 8,281,712 | B1 * | 10/2012 | Hoffa | B21F 3/00 100/31 |

(Continued)

FOREIGN PATENT DOCUMENTS

| | | | |
|---|---|---|---|
| CN | 1985058 | A | 6/2007 |
| CN | 107031891 | A | 8/2017 |

(Continued)

OTHER PUBLICATIONS

Sawano, Translation of JP-2000263461 (Year: 2000).*

(Continued)

*Primary Examiner* — Bobby Yeonjin Kim
(74) *Attorney, Agent, or Firm* — WEIHROUCH IP

(57) ABSTRACT

A binding machine includes: a wire feeding unit; a curl forming unit; a cutting unit; a binding unit; a motor; and a control unit. The binding unit includes: a rotary shaft to be driven by the motor; a wire engaging body configured to engage the wire and to rotate together with the rotary shaft, thereby twisting the wire; and a rotation regulation part configured to regulate rotation of the wire engaging body. The control unit is configured to control stop of the motor rotating in a direction of twisting the wire, based on a position in a rotation direction of the wire engaging body and a position at which the rotation of the wire engaging body can be regulated by the rotation regulation part.

8 Claims, 10 Drawing Sheets

(56) References Cited

U.S. PATENT DOCUMENTS

| | | | | |
|---|---|---|---|---|
| 8,752,593 | B2 * | 6/2014 | Kusakari | B65B 13/025 72/119 |
| 9,004,114 | B2 * | 4/2015 | Kasahara | E04G 21/122 173/217 |
| 2005/0224131 | A1 | 10/2005 | Ishii et al. | |
| 2007/0199610 | A1 | 8/2007 | Itagaki | |
| 2009/0283167 | A1 | 11/2009 | Nakagawa et al. | |
| 2009/0283170 | A1 | 11/2009 | Nagaoka | |
| 2009/0283171 | A1 | 11/2009 | Nagaoka et al. | |
| 2012/0132312 | A1 | 5/2012 | Lamb | |
| 2014/0091171 | A1 | 4/2014 | Nakagawa et al. | |
| 2015/0266082 | A1 | 9/2015 | Horn | |
| 2016/0031576 | A1 | 2/2016 | Shindou | |
| 2017/0130472 | A1 | 5/2017 | Nakagawa et al. | |
| 2017/0218631 | A1 | 8/2017 | Matsuno | |
| 2018/0148943 | A1 | 5/2018 | Itagaki et al. | |
| 2018/0155940 | A1 | 6/2018 | Nagaoka et al. | |
| 2018/0161848 | A1 | 6/2018 | Itagaki et al. | |
| 2018/0187431 | A1 | 7/2018 | Itagaki et al. | |
| 2018/0187434 | A1 | 7/2018 | Itagaki et al. | |
| 2018/0187435 | A1 | 7/2018 | Itagaki et al. | |
| 2018/0195299 | A1 | 7/2018 | Itagaki | |
| 2019/0249447 | A1 | 8/2019 | Itagaki et al. | |
| 2019/0257097 | A1 * | 8/2019 | Kawai | B21F 15/04 |
| 2019/0292799 | A1 | 9/2019 | Tagaki et al. | |
| 2020/0002963 | A1 | 1/2020 | Kawazoe | |
| 2020/0149279 | A1 | 5/2020 | Matsuno | |
| 2020/0378140 | A1 | 12/2020 | Itagaki et al. | |
| 2020/0399914 | A1 | 12/2020 | Nagaoka et al. | |
| 2021/0010282 | A1 | 1/2021 | Itagaki et al. | |
| 2021/0114080 | A1 | 4/2021 | Itagaki et al. | |
| 2021/0138527 | A1 | 5/2021 | Itagaki et al. | |
| 2021/0189746 | A1 | 6/2021 | Itagaki | |
| 2021/0245904 | A1 | 8/2021 | Itagaki et al. | |
| 2021/0245906 | A1 | 8/2021 | Morimura et al. | |
| 2023/0039457 | A1 | 2/2023 | Kawazoe | |

FOREIGN PATENT DOCUMENTS

| | | | | |
|---|---|---|---|---|
| CN | 107849858 | A | 3/2018 | |
| CN | 108327970 | A | 7/2018 | |
| CN | 108454928 | A | 8/2018 | |
| CN | 108457474 | A | 8/2018 | |
| CN | 110656779 | A | 1/2020 | |
| JP | H05-330507 | B2 | 12/1993 | |
| JP | H06-156420 | A | 6/1994 | |
| JP | 2000263461 | A * | 9/2000 | |
| JP | 3227693 | B2 | 9/2001 | |
| RU | 2679079 | C2 | 2/2019 | |
| TW | 249787 | B | 6/1995 | |
| WO | WO-9608414 | A1 * | 3/1996 | B65B 13/28 |
| WO | 03/080445 | A1 | 10/2003 | |

OTHER PUBLICATIONS

Berger, Translation of WO-9608414 (Year: 1996).*

Chilean Office Action corresponding to Chilean Patent Application No. 202100360 dated May 17, 2022. (15 pages).

Russian Office Action for corresponding Russian Application No. 2021103126 dated May 10, 2023 with English Translation. (17 pp.).

Chinese Office Action dated May 31, 2023, issued by the Chinese Patent Office in the corresponding Chinese Patent Application No. 202110183153.4 (9 pages).

* cited by examiner

BINDING MACHINE

CROSS-REFERENCE TO RELATED APPLICATION(S)

This application is based upon and claims the benefit of priority from prior Japanese patent application No. 2020-021026, filed on Feb. 10, 2020, the entire contents of which are incorporated herein by reference.

TECHNICAL FIELD

The present invention relates to a binding machine configured to bind a to-be-bound object such as a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine configured to wind two or more reinforcing bars with a wire, and to twist the wire wound on the reinforcing bar, thereby binding the two or more reinforcing bars with the wire. The binding machine is configured to cause the wire fed with a drive force of a motor to pass through a guide referred to as a curl guide and configured to form the wire with a curl, thereby winding the wire around the reinforcing bars. A guide referred to as an induction guide guides the curled wire to a binding unit configured to twist the wire, so that the wire wound around the reinforcing bars is twisted by the binding unit and the reinforcing bars are thus bound with the wire.

When binding the reinforcing bars with the wire, if the binding is loosened, the reinforcing bars deviate each other, so that it is required to firmly maintain the reinforcing bars. Therefore, conceived is a means capable of rotating a tortional shaft up to predetermined load torque (for example, refer to PTL 1). In addition, conceived is a means for using a rate of change in drive torque to prevent a wire from not being completely twisted and binding from being loosened when twisting and fastening the wire (for example, refer to PTL 2).

[PTL 1] JP-A-H05-330507

[PTL 2] Japanese Patent No. 3,227,693

In a configuration where an outer periphery of a sleeve configured to rotate together with a tortional shaft is provided with a plurality of projections, a stopper to engage with the projections is provided, and rotation of the sleeve is regulated, when a motor is stopped by rotating forward the tortional shaft up to predetermined load torque, the sleeve is put into a state in which the sleeve can be reversely rotated according to intervals of the projections. For this reason, when the motor is stopped, a distance from the projection to the stopper varies according to a position at which the rotation of the sleeve is stopped. Therefore, when the rotation of the motor is sopped at a position, at which the distance from the projection to the stopper is distant, between the projections aligned in a rotation direction, the wire is highly likely to be loosened.

The present invention has been made in view of the above situations, and an object thereof is to provide a binding machine capable of suppressing a twisted wire from being loosened.

SUMMARY OF INVENTION

According to an aspect of the present invention, there is provided a binding machine comprising: a wire feeding unit configured to feed a wire; a curl forming unit configured to form a path along which the wire fed by the wire feeding unit is to be wound around a to-be-bound object; a cutting unit configured to cut the wire wound on the to-be-bound object; a binding unit configured to twist the wire wound on the to-be-bound object; a motor configured to drive the binding unit; and a control unit configured to control the motor, wherein the binding unit comprises: a rotary shaft to be driven by the motor; a wire engaging body configured to engage the wire and to rotate together with the rotary shaft, thereby twisting the wire; and a rotation regulation part configured to regulate rotation of the wire engaging body, and wherein the control unit is configured to control stop of the motor rotating in a direction of twisting the wire, based on a position in a rotation direction of the wire engaging body and a position at which the rotation of the wire engaging body can be regulated by the rotation regulation part.

According to an aspect of the present invention, when it is determined that it is a timing to stop the motor rotating in the direction of twisting the wire, the rotation amount of the motor up to the position at which the rotation amount of the wire engaging body up to the position at which the rotation of the wire engaging body can be regulated by the rotation regulation part is smallest is calculated, the motor is rotated by the rotation amount, and the motor is then stopped.

According to an aspect of the present invention, there is also provided a binding machine comprising: a wire feeding unit configured to feed a wire; a curl forming unit configured to form a path along which the wire fed by the wire feeding unit is to be wound around a to-be-bound object; a cutting unit configured to cut the wire wound on the to-be-bound object; a binding unit configured to twist the wire wound on the to-be-bound object; a motor configured to drive the binding unit; and a control unit configured to control the motor, wherein the binding unit comprises: a rotary shaft to be driven by the motor; a wire engaging body configured to engage the wire and to rotate together with the rotary shaft, thereby twisting the wire; a check member configured to engage with the wire engaging body and to regulate rotation of the wire engaging body; and a check member drive unit configured to drive the check member, and wherein when it is determined to stop the motor rotating in a direction of twisting the wire, the control unit stops the motor, and controls the check member drive unit to cause the check member to engage with the wire engaging body.

According to an aspect of the present invention, when it is determined that it is a timing to stop the motor rotating in the direction of twisting the wire, the motor is stopped, and the check member drive unit is controlled, and the check member is engaged with the wire engaging body, so that the rotation of the wire engaging body is regulated.

According to an aspect of the present invention, there is further provided a binding machine comprising: a wire feeding unit configured to feed a wire; a curl forming unit configured to form a path along which the wire fed by the wire feeding unit is to be wound around a to-be-bound object; a cutting unit configured to cut the wire wound on the to-be-bound object; and a binding unit configured to be driven by a motor and to twist the wire wound on the to-be-bound object, wherein the binding unit comprises: a rotary shaft to be driven by the motor; a wire engaging body configured to engage the wire and to rotate together with the rotary shaft, thereby twisting the wire; and a rotation regulation part configured to regulate rotation of the wire engaging body, wherein the rotation regulation part comprises: a plurality of rotation regulation blades aligned in a rotation direction of the wire engaging body; and a plurality of check members configured to be engaged to the rotation regulation blades, and wherein engaging positions where the check members are engaged to the rotation regulation blades are arranged in the rotation direction of the wire engaging body.

According to an aspect of the present invention, it is possible to narrow the interval of the engaging positions of the rotation regulation blades and the check members with respect to the intervals of the plurality of rotation regulation blades aligned in the rotation direction of the wire engaging body.

According to the present invention, the reverse rotation amount of the wire engaging body is suppressed, so that the twisted portion of the wire can be suppressed from being loosened.

DESCRIPTION OF EMBODIMENTS

Hereinbelow, an example of a reinforcing bar binding machine that is an embodiment of the binding machine of the present invention will be described with reference to the drawings.

Configuration Example of Reinforcing Bar Binding Machine

Figure 1:
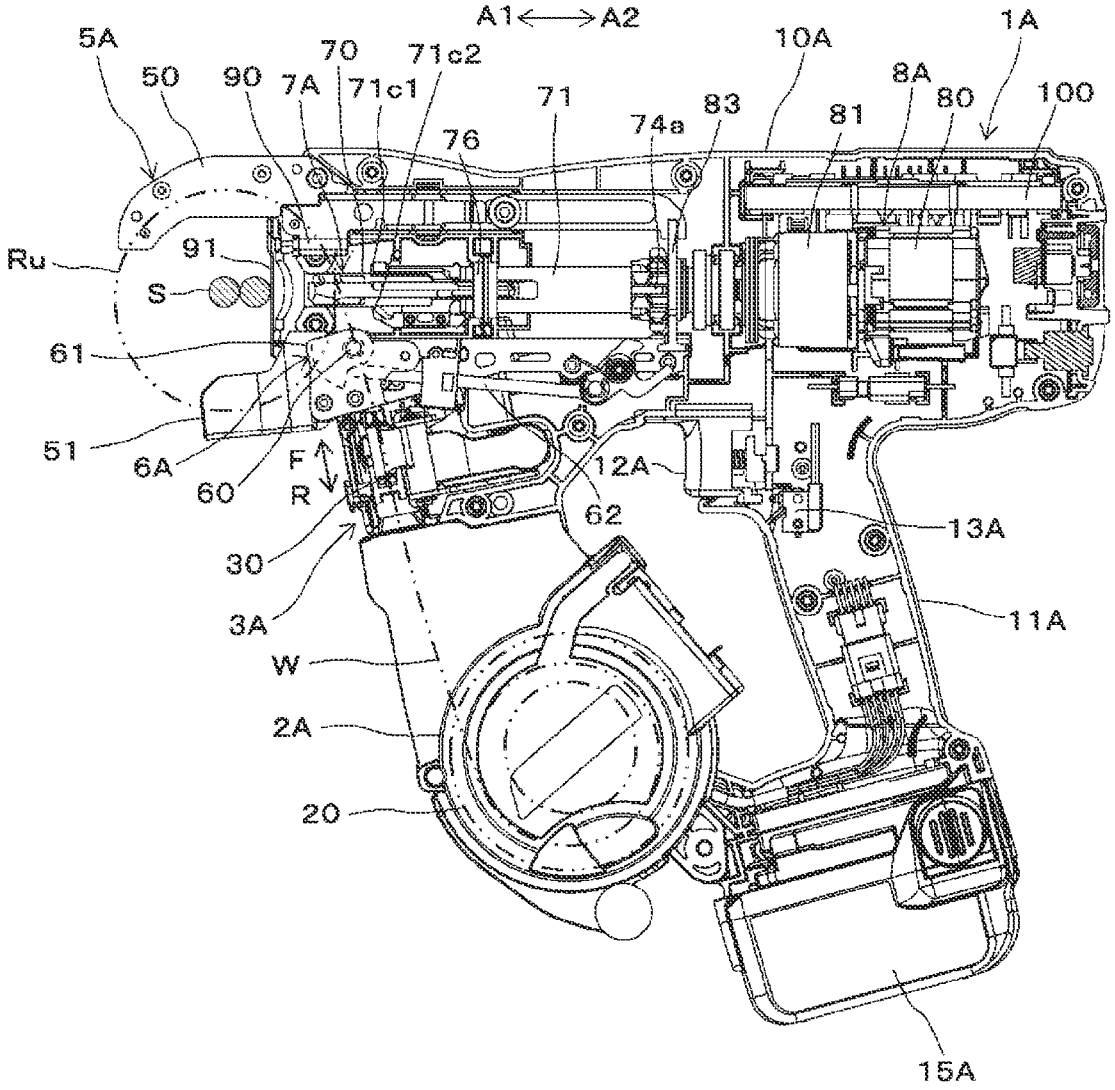
FIG. 1 is a view depicting an example of an entire configuration of a reinforcing bar binding machine, as seen from a side.

FIG. 1 is a view depicting an example of an entire configuration of a reinforcing bar binding machine, as seen from a side. A reinforcing bar binding machine 1A has such a shape that an operator grips with a hand, and includes a main body part 10A and a handle part 11A.

The reinforcing bar binding machine 1A is configured to feed a wire W in a forward direction denoted with an arrow F, to wind the wire around reinforcing bars S, which are a to-be-bound object, to feed the wire W wound around the reinforcing bars S in a reverse direction denoted with an arrow R, to wind the wire on the reinforcing bars S, and to twist the wire W, thereby binding the reinforcing bars S with the wire W.

In order to implement the above functions, the reinforcing bar binding machine 1A includes a magazine 2A in which the wire W is accommodated, and a wire feeding unit 3A configured to feed the wire W. The reinforcing bar binding machine 1A also includes a curl forming unit 5A configured to form a path along which the wire W fed by the wire feeding unit 3A is to be wound around the reinforcing bars S, and a cutting unit 6A configured to cut the wire W wound on the reinforcing bars S. The reinforcing bar binding machine 1A also includes a binding unit 7A configured to twist the wire W wound on the reinforcing bars S, and a drive unit 8A configured to drive the binding unit 7A.

The magazine 2A is an example of an accommodation unit in which a reel 20 on which the long wire W is wound to be reeled out is rotatably and detachably accommodated. For the wire W, a wire made of a plastically deformable metal wire, a wire having a metal wire covered with a resin, a twisted wire and the like are used. The reel 20 is configured so that one or more wires W are wound on a hub part (not shown) and can be reeled out from the reel 20 at the same time.

The wire feeding unit 3A includes a pair of feeding gears 30 configured to sandwich and feed one or more wires W aligned in parallel. In the wire feeding unit 3A, a rotating operation of a feeding motor (not shown) is transmitted to rotate the feeding gears 30. Thereby, the wire feeding unit 3A feeds the wire W sandwiched between the pair of feeding gears 30 along an extension direction of the wire W. In a configuration where a plurality of, for example, two wires W are fed, the two wires W are fed aligned in parallel.

The wire feeding unit 3A is configured so that the rotation directions of the feeding gears 30 are switched and the feeding direction of the wire W is switched between forward and reverse directions by switching the rotation direction of the feeding motor (not shown) between forward and reverse directions.

The curl forming unit 5A includes a curl guide 50 configured to curl the wire W that is fed by the wire feeding unit 30, and an induction guide 51 configured to guide the wire W curled by the curl guide 50 toward the binding unit 7A. In the reinforcing bar binding machine 1A, a path of the wire W that is fed by the wire feeding unit 3A is regulated by the curl forming unit 5A, so that a locus of the wire W becomes a loop Ru as shown with a broken line in FIG. 1 and the wire W is thus wound around the reinforcing bars S.

The cutting unit 6A includes a fixed blade part 60, a movable blade part 61 configured to cut the wire W in cooperation with the fixed blade part 60, and a transmission mechanism 62 configured to transmit an operation of the binding unit 7A to the movable blade part 61. The cutting unit 6A is configured to cut the wire W by a rotating operation of the movable blade part 61 about the fixed blade part 60, which is a support point. The transmission mechanism 62 is configured to transmit an operation of the binding unit 7A to the movable blade part 61 via a movable member 83 and to rotate the movable blade part 61 in conjunction with an operation of the binding unit 7A, thereby cutting the wire W.

The binding unit 7A includes a wire engaging body 70 to which the wire W is engaged. A detailed embodiment of the binding unit 7A will be described later. The drive unit 8A includes a motor 80, and a decelerator 81 configured to perform deceleration and amplification of torque.

The reinforcing bar binding machine 1A includes a feeding regulation part 90 against which a tip end of the wire W is butted, on a feeding path of the wire W that is engaged by the wire engaging body 70. In the reinforcing bar binding machine 1A, the curl guide 50 and the induction guide 51 of the curl forming unit 5A are provided at an end portion on a front side of the main body part 10A. In the reinforcing bar binding machine 1A, a butting part 91 against which the reinforcing bars S are to be butted is provided at the end portion on the front side of the main body part 10A and between the curl guide 50 and the induction guide 51.

In the reinforcing bar binding machine 1A, the handle part 11A extends downwardly from the main body part 10A. Also, a battery 15A is detachably mounted to a lower part of the handle part 11A. Also, the magazine 2A of the reinforcing bar binding machine 1A is provided in front of the handle part 11A. In the main body part 10A of the reinforcing bar binding machine 1A, the wire feeding unit 3A, the cutting unit 6A, the binding unit 7A, the drive unit 8A configured to drive the binding unit 7A, and the like are accommodated.

A trigger 12A is provided on a front side of the handle part 11A of the reinforcing bar binding machine 1A, and a switch 13A is provided inside the handle part 11A. In addition, the main body part 10A is provided with a substrate 100 on which a circuit configuring the control unit is mounted.

Configuration Example of Binding Unit of First Embodiment

Figure 2A:
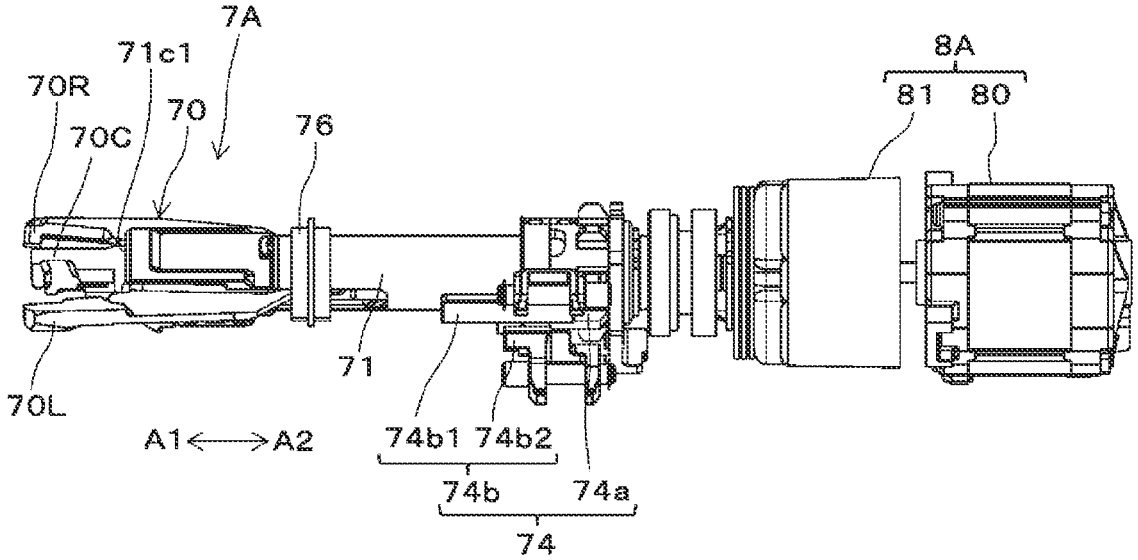
FIG. 2A is a perspective view depicting an example of a binding unit of a first embodiment.
Figure 2B:
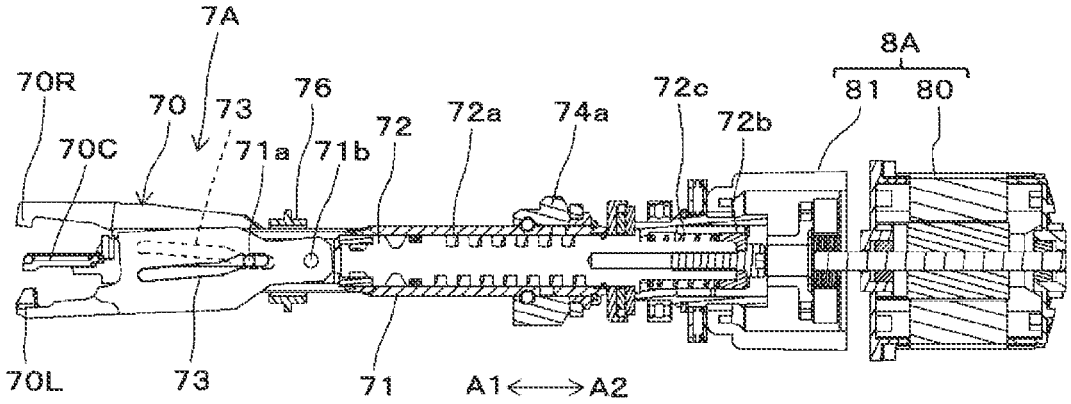
FIG. 2B is a sectional plan view depicting an example of the binding unit of the first embodiment.

FIG. 2A is a perspective view depicting an example of a binding unit of a first embodiment, and FIG. 2B is a sectional plan view depicting an example of the binding unit of the first embodiment. In the below, a configuration of the binding unit of the first embodiment is described with reference to the drawings.

The binding unit 7A includes a wire engaging body 70 to which the wire W is to be engaged, and a rotary shaft 72 for actuating the wire engaging body 70. The binding unit 7A and the drive unit 8A are configured so that the rotary shaft 72 and the motor 80 are connected each other via the decelerator 81 and the rotary shaft 72 is driven via the decelerator 81 by the motor 80.

The wire engaging body 70 has a center hook 70C connected to the rotary shaft 72, a first side hook 70L and a second side hook 70R configured to open and close with respect to the center hook 70C, and a sleeve 71 configured to actuate the first side hook 70L and the second side hook 70R and to form the wire W into a desired shape.

In the binding unit 7A, a side on which the center hook 70C, the first side hook 70L and the second side hook 70R are provided is referred to as a front side, and a side on which the rotary shaft 72 is connected to the decelerator 81 is referred to as a rear side.

The center hook 70C is connected to a front end of the rotary shaft 72, which is an end portion on one side, via a configuration that can rotate with respect to the rotary shaft 72 and move integrally with the rotary shaft 72 in an axis direction.

A tip end-side of the first side hook 70L, which is an end portion on one side in the axis direction of the rotary shaft 72, is positioned at a side part on one side with respect to the center hook 70C. A rear end-side of the first side hook 70L, which is an end portion on the other side in the axis direction of the rotary shaft 72, is rotatably supported to the center hook 70C by a shaft 71*b*.

A tip end-side of the second side hook 70R, which is an end portion on one side in the axis direction of the rotary shaft 72, is positioned at a side part on the other side with respect to the center hook 70C. A rear end-side of the second side hook 70R, which is an end portion on the other side in the axis direction of the rotary shaft 72, is rotatably supported to the center hook 70C by the shaft 71*b*.

Thereby, the wire engaging body 70 opens/closes in directions in which the tip end-side of the first side hook 70L separates and contacts with respect to the center hook 70C by a rotating operation about the shaft 71*b* as a support point. The wire engaging body 70 also opens/closes in directions in which the tip end-side of the second side hook 70R separates and contacts with respect to the center hook 70C.

A rear end of the rotary shaft 72, which is an end portion on the other side, is connected to the decelerator 81 via a connection portion 72*b* having a configuration that can cause the connection portion to rotate integrally with the decelerator 81 and to move in the axis direction with respect to the decelerator 81. The connection portion 72*b* has a spring 72*c* for urging backward the rotary shaft 72 toward the decelerator 81. Thereby, the rotary shaft 72 is configured to be movable forward away from the decelerator 81 while receiving a force pulled backward by the spring 72*c*.

The sleeve 71 is supported so as to be rotatable and slidable in the axis direction by a support frame 76. The support frame 76 is an annular member, and is attached to the main body part 10A in such a manner that it cannot rotate in the circumferential direction and cannot move in the axis direction.

The sleeve 71 has a convex portion (not shown) protruding from an inner peripheral surface of a space in which the rotary shaft 72 is inserted, and the convex portion enters a groove portion of a feeding screw 72*a* formed along the axis direction on an outer periphery of the rotary shaft 72. When the rotary shaft 72 rotates, the sleeve 71 moves in a front and rear direction along the axis direction of the rotary shaft 72 according to a rotation direction of the rotary shaft 72 by an action of the convex portion (not shown) and the feeding screw 72*a* of the rotary shaft 72. The sleeve 71 also rotates integrally with the rotary shaft 72.

The sleeve 71 has an opening/closing pin 71*a* configured to open/close the first side hook 70L and the second side hook 70R.

The opening/closing pin 71*a* is inserted into opening/closing guide holes 73 formed in the first side hook 70L and the second side hook 70R. The opening/closing guide hole 73 has a shape of extending in a moving direction of the sleeve 71 and converting linear motion of the opening/closing pin 71*a* configured to move in conjunction with the sleeve 71 into an opening/closing operation by rotation of the first side hook 70L and the second side hook 70R about the shaft 71*b* as a support point.

The wire engaging body 70 is configured so that, when the sleeve 71 is moved backward (refer to an arrow A2), the first side hook 70L and the second side hook 70R move away from the center hook 70C by the rotating operations about the shaft 71*b* as a support point, due to a locus of the opening/closing pin 71*a* and the shape of the opening/closing guide holes 73.

Thereby, the first side hook 70L and the second side hook 70R are opened with respect to the center hook 70C, so that a feeding path through which the wire W is to pass is formed between the first side hook 70L and the center hook 70C and between the second side hook 70R and the center hook 70C.

In a state where the first side hook 70L and the second side hook 70R are opened with respect to the center hook 70C, the wire W that is fed by the wire feeding unit 3A passes between the center hook 70C and the first side hook 70L. The wire W passing between the center hook 70C and the first side hook 70L is guided to the curl forming unit 5A. Then, the wire curled by the curl forming unit 5A and guided to the binding unit 7A passes between the center hook 70C and the second side hook 70R.

The wire engaging body 70 is configured so that, when the sleeve 71 is moved in the forward direction denoted with an arrow A1, the first side hook 70L and the second side hook 70R move toward the center hook 70C by the rotating operations about the shaft 76 as a support point, due to the locus of the opening/closing pin 71*a* and the shape of the opening/closing guide holes 73. Thereby, the first side hook 70L and the second side hook 70R are closed with respect to the center hook 70C.

When the first side hook 70L is closed with respect to the center hook 70C, the wire W sandwiched between the first side hook 70L and the center hook 70C is engaged in such a manner that the wire can move between the first side hook 70L and the center hook 70C. Also, when the second side hook 70R is closed with respect to the center hook 70C, the wire W sandwiched between the second side hook 70R and the center hook 70C is engaged in such a manner that the wire cannot come off between the second side hook 70R and the center hook 70C.

The sleeve 71 has a bending portion 71*c*1 configured to push and bend a tip end-side (end portion on one side) of the wire W in a predetermined direction to form the wire W into a predetermined shape, and a bending portion 71*c*2 configured to push and bend a terminal end-side (end portion on the other side) of the wire W cut by the cutting unit 6A in a predetermined direction to form the wire W into a predetermined shape.

The sleeve 71 is moved in the forward direction denoted with the arrow A1, so that the tip end-side of the wire W engaged by the center hook 70C and the second side hook 70R is pushed and is bent toward the reinforcing bars S by the bending portion 71*c*1. Also, the sleeve 71 is moved in the forward direction denoted with the arrow A1, so that the terminal end-side of the wire W engaged by the center hook 70C and the first side hook 70L and cut by the cutting unit 6A is pushed and is bent toward the reinforcing bars S by the bending portion 71*c*2.

The binding unit 7A includes a rotation regulation part 74 configured to regulate rotations of the wire engaging body 70 and the sleeve 71 in conjunction with the rotating operation of the rotary shaft 72. The rotation regulation part 74 has rotation regulation blades 74*a* provided to the sleeve 71 and a rotation regulation claw 74*b* provided to the main body part 10A.

The rotation regulation blades 74*a* are configured by a plurality of convex portions protruding diametrically from an outer periphery of the sleeve 71 and provided with predetermined intervals in a circumferential direction of the sleeve 71. In the present example, the eight rotation regulation blades 74*a* are formed with intervals of 45°. The rotation regulation blades 74*a* are fixed to the sleeve 71 and are moved and rotated integrally with the sleeve 71.

The rotation regulation claw 74*b* has a first claw portion 74*b*1 and a second claw portion 74*b*2, as a pair of claw portions facing each other with an interval through which the rotation regulation blade 74*a* can pass. The first claw portion 74*b*1 and the second claw portion 74*b*2 are configured to be retractable from a locus of the rotation regulation blades 74*a* by being pushed by the rotation regulation blades 74*a* according to the rotation direction of the rotation regulation blades 74*a*.

In an operation area, in which the wire W is bent and formed by the bending portions 71*c*1 and 71*c*2 of the sleeve 71, of a first operation area where the wire W is engaged by the wire engaging body 70 and a second operation area until the wire W engaged by the wire engaging body 70 is twisted, the rotation regulation blade 74*a* of the rotation regulation part 74 is engaged to the rotation regulation claw 74*b*. Thereby, the rotation of the sleeve 71 in conjunction with the rotation of the rotary shaft 72 is regulated, so that the sleeve 71 is moved in the front and rear direction by the rotating operation of the rotary shaft 72. Also, in an operation area, in which the wire W is twisted, of the second operation area until the wire W engaged by the wire engaging body 70 is twisted, the rotation regulation blade 74*a* of the rotation regulation part 74 is disengaged from the rotation regulation claw 74*b*, so that the sleeve 71 is rotated in conjunction with the rotation of the rotary shaft 72. The center hook 70C, the first side hook 70L and the second side hook 70R of the wire engaging body 70 engaging the wire W are rotated in conjunction with the rotation of the sleeve 71.

Figure 3:
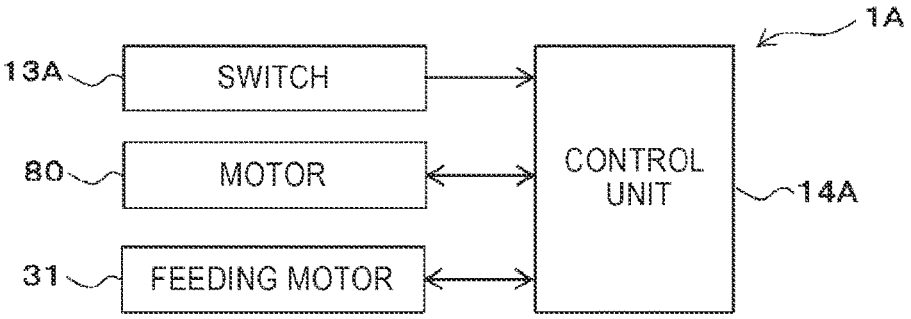
FIG. 3 is a block diagram depicting an example of a control function of the first embodiment of the reinforcing bar binding machine.

FIG. 3 is a block diagram depicting an example of a control function of the first embodiment of the reinforcing bar binding machine. In the reinforcing bar binding machine 1A, the control unit 14A is configured to control the motor 80 and the feeding motor 31 configured to drive the feeding gears 30, according to a state of the switch 13A that is pushed by an operation of the trigger 12A shown in FIG. 1.

The motor 80 is a brushless motor, and the control unit 14A can recognize and control a rotation amount (rotation angle) of the motor 80. Therefore, when the control unit 14A detects a load applied to the motor 80 and detects that the load reaches the maximum, the control unit 14A calculates the rotation amount of the motor 80 until the rotation of the motor 80 is stopped, based on the position of the rotation regulation claw 74*b*. After the maximum load is detected, the motor 80 is rotated by a predetermined amount and the forward rotation of the motor 80 is then stopped.

Example of Operation of Reinforcing Bar Binding Machine

Subsequently, an operation of binding the reinforcing bars S with the wire W by the reinforcing bar binding machine 1A is described with reference to the respective drawings.

The reinforcing bar binding machine 1A is in a standby state where the wire W is sandwiched between the pair of feeding gears 30 and the tip end of the wire W is positioned between the sandwiched position by the feeding gear 30 and the fixed blade part 60 of the cutting unit 6A. Also, as shown in FIGS. 2A and 2B, when the reinforcing bar binding machine 1A is in the standby state, the first side hook 70L is opened with respect to the center hook 70C and the second side hook 70R is opened with respect to the center hook 70C.

When the reinforcing bars S are inserted between the curl guide 50 and the induction guide 51A of the curl forming unit 5A and the trigger 12A is operated, the control unit 14A drives the feeding motor 31 in the forward rotation direction, and feeds the wire W in the forward direction denoted with the arrow F by the wire feeding unit 3A.

In a configuration where a plurality of, for example, two wires W are fed, the two wire W are fed aligned in parallel along an axis direction of the loop Ru, which is formed by the wires W, by a wire guide (not shown).

The wire W fed in the forward direction passes between the center hook 70C and the first side hook 70L and is then fed to the curl guide 50 of the curl forming unit 5A. The wire W passes through the curl guide 50, so that it is curled to be wound around the reinforcing bars S.

The wire W curled by the curl guide 50 is guided to the induction guide 51 and is further fed in the forward direction by the wire feeding unit 3A, so that the wire is guided between the center hook 70C and the second side hook 70R by the induction guide 51. The wire W is fed until the tip end is butted against the feeding regulation part 90. When the wire W is fed to a position at which the tip end is butted against the feeding regulation part 90, the control unit 14A stops the drive of the feeding motor 31.

After stopping the feeding of the wire W in the forward direction, the control unit 14A drives the motor 80 in the forward rotation direction. In the first operation area where the wire W is engaged by the wire engaging body 70, the rotation regulation blade 74*a* is engaged to the rotation regulation claw 74*b*, so that the rotation of the sleeve 71 in conjunction with the rotation of the rotary shaft 72 is regulated. Thereby, the rotation of the motor 80 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, the first side hook 70L is moved toward the center hook 70C by the rotating operation about the shaft 71*b* as a support point. When the first side hook 70L is closed with respect to the center hook 70C, the wire W sandwiched between the first side hook 70L and the center hook 70C is engaged in such a manner that the wire can move between the first side hook 70L and the center hook 70C.

Also, the second side hook 70R is moved toward the center hook 70C by the rotating operation about the shaft 71*b* as a support point. When the second side hook 70R is closed with respect to the center hook 70C, the wire W sandwiched between the second side hook 70R and the center hook 70C is engaged is in such a manner that the wire cannot come off between the second side hook 70R and the center hook 70C.

After the sleeve 71 is advanced to a position at which the wire W is engaged by the closing operation of the first side hook 70L and the second side hook 70R, the control unit 14A temporarily stops the rotation of the motor 80 and then drives the feeding motor 31 in the reverse rotation direction. Thereby, the pair of feeding gears 30 is reversely rotated.

Therefore, the wire W sandwiched between the pair of feeding gears 30 is fed in the reverse direction denoted with the arrow R. Since the tip end-side of the wire W is engaged in such a manner that the wire cannot come off between the second side hook 70R and the center hook 70C, the wire W is wound on the reinforcing bars S by the operation of feeding the wire W in the reverse direction.

After pulling back the wire W to a position at which the wire W is wound on the reinforcing bars S and stopping the drive of the feeding motor 31 in the reverse rotation direction, the control unit 14A drives the motor 80 in the forward rotation direction, thereby moving the sleeve 71 in the forward direction denoted with the arrow A1. The forward movement of the sleeve 71 is transmitted to the cutting unit 6A by the transmission mechanism 62, so that the movable blade part 61 is rotated and the wire W engaged by the first side hook 70L and the center hook 70C is cut by the operation of the fixed blade part 60 and the movable blade part 61.

The bending portions 71*c*1 and 71*c*2 are moved toward the reinforcing bars S substantially at the same time when the wire W is cut. Thereby, the tip end-side of the wire W engaged by the center hook 70C and the second side hook 70R is pressed toward the reinforcing bars S and bent toward the reinforcing bars S at the engaging position as a support point by the bending portion 71*c*1. The sleeve 71 is further moved in the forward direction, so that the wire W engaged between the second side hook 70R and the center hook 70C is sandwiched and maintained by the bending portion 71*c*1.

Also, the terminal end-side of the wire W engaged by the center hook 70C and the first side hook 70L and cut by the cutting unit 6A is pressed toward the reinforcing bars S and bent toward the reinforcing bars S at the engaging point as a support point by the bending portion 71*c*2. The sleeve 71 is further moved in the forward direction, so that the wire W engaged between the first side hook 70L and the center hook 70C is sandwiched and maintained by the bending portion 71*c*2.

After the tip end-side and the terminal end-side of the wire W are bent toward the reinforcing bars S, the motor 80 is further driven in the forward rotation direction, so that the sleeve 71 is further moved in the forward direction. When the sleeve 71 is moved to a predetermined position and reaches the operation area where the wire W engaged by the wire engaging body 70 is twisted, the engaging of the rotation regulation blade 74*a* with the rotation regulation claw 74*b* is released.

Thereby, the motor 80 is further driven in the forward rotation direction, so that the wire engaging body 70 is rotated in conjunction with the rotary shaft 72, thereby twisting the wire W.

In the binding unit 7A, in the operation area where the sleeve 71 rotates, the reinforcing bars S are butted against the butting part 91 and the backward movement of the reinforcing bars S toward the binding unit 7A is regulated. Therefore, the wire W is twisted, so that a force of pulling the wire engaging body 70 forward along the axis direction of the rotary shaft 72 is applied.

When the force of moving the wire engaging body 70 forward along the axis direction of the rotary shaft 72 is applied to the wire engaging body 70, the rotary shaft 72 can move forward while receiving a force pushed backward by the spring 72*c*. Thereby, in the binding unit 7A, in the operation area where the sleeve 71 rotates, the wire engaging body 70 and the rotary shaft 72 twist the wire W while moving forward.

Figure 4:
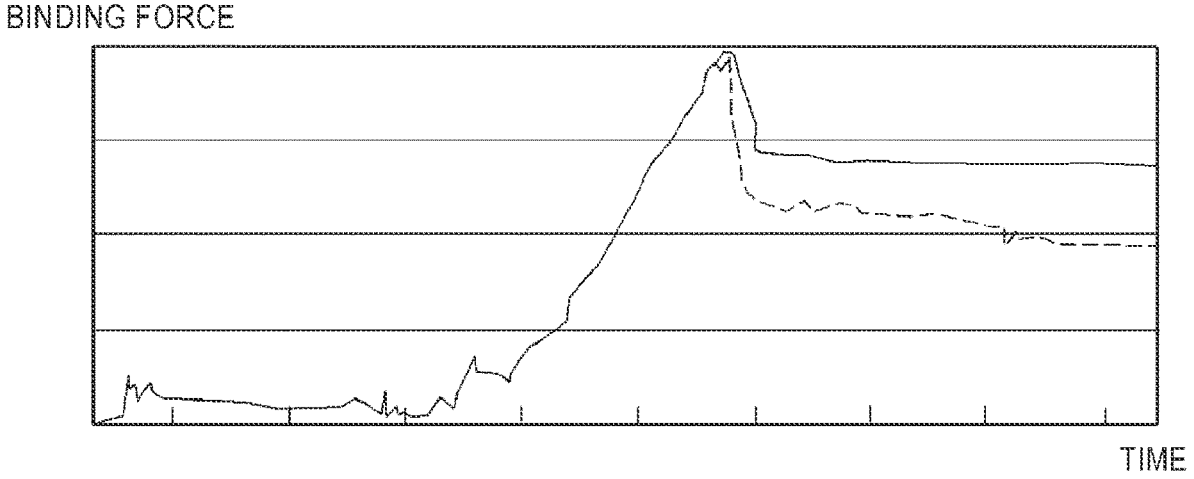
FIG. 4 is a graph depicting a binding force between reinforcing bars.

FIG. 4 is a graph depicting a binding force between the reinforcing bars. The wire W is twisted, so that the binding force increases.

When the control unit 14A detects the load applied to the motor 80 and detects that the load reaches the maximum, as a rate of change in the drive torque switches from increment to decrement, the control unit 14A calculates a rotation amount D of the motor 80 until the rotation of the motor 80 is stopped, based on a position of the sleeve 71 in the rotation direction and a position of the rotation regulation claw 74*b*. Note that, the position of the sleeve 71 in the rotation direction is the same as a position of the wire engaging body 70 in the rotation direction. The position of the rotation regulation claw 74*b* is a position at which the rotation of the sleeve 71 (wire engaging body 70) can be regulated by engagement of any one rotation regulation blade 74*a* with the rotation regulation claw 74*b* by the rotation regulation part 74. The rotation amount D until the rotation of the motor 80 is stopped is the smallest rotation amount until the rotation regulation blade 74*a* is engaged to the rotation regulation claw 74*b* when the wire engaging body 70 is reversely rotated.

After detecting the maximum value of the load applied to the motor 80, the control unit 14A further rotates the motor 80 by the predetermined rotation amount D and then stops the forward rotation of the motor 80.

The binding force that is obtained in the case where after the maximum value of the load applied to the motor 80 is detected, the motor 80 is further rotated by the predetermined rotation amount D and the forward rotation of the motor 80 is then stopped is shown with the solid line in FIG. 4. Also, the binding force that is obtained in a case where the forward rotation of the motor 80 is stopped at the time when the maximum value of the load applied to the motor 80 is detected is shown with the broken line in FIG. 4.

Thereby, after the maximum value of the load applied to the motor 80 is detected, the motor 80 is further rotated by the predetermined rotation amount D and the forward rotation of the motor 80 is then stopped, so that a reverse rotation amount of the wire engaging body 70 is suppressed and the twisted portion of the wire W is suppressed from being loosened.

When the control unit 14A reversely rotates the motor 80 and the motor 80 is thus driven in the reverse rotation direction, the rotation regulation blade 74*a* is engaged to the rotation regulation claw 74*b*, so that the rotation of the sleeve 71 in conjunction with the rotation of the rotary shaft 72 is regulated. Thereby, the sleeve 71 is moved in the backward direction denoted with the arrow A2.

When sleeve 71 is moved backward, the bending portions 71*c*1 and 71*c*2 separate from the wire W and the engaged state of the wire W by the bending portions 71*c*1 and 71*c*2 is released. Also, when the sleeve 71 is moved backward, the opening/closing pin 71*a* passes through the opening/closing guide holes 73. Thereby, the first side hook 70L is moved away from the center hook 70C by the rotating operation about the shaft 71*b* as a support point. The second side hook 70R is also moved away from the center hook 70C by the rotating operation about the shaft 71*b* as a support point. Thereby, the wire W comes off from the wire engaging body 70.

Configuration Example of Binding Unit of Second Embodiment

Figure 5A:
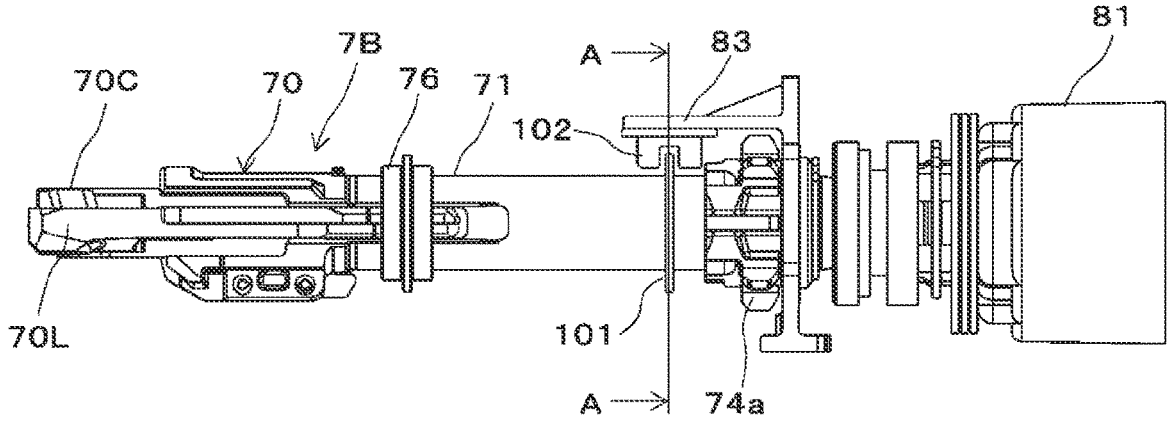
FIG. 5A is a side view depicting an example of a binding unit of a second embodiment.
Figure 5B:
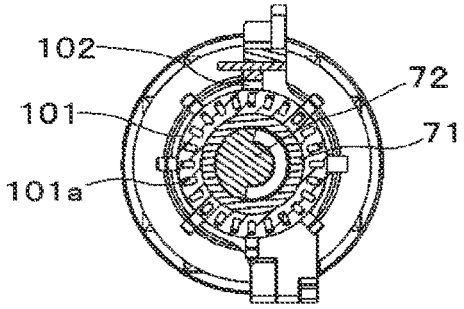
FIG. 5B is a sectional view depicting an example of the binding unit of the second embodiment.

FIG. 5A is a side view depicting an example of a binding unit of a second embodiment, and FIG. 5B is a sectional view taken along a line A-A of FIG. 5A, depicting an example of the binding unit of the second embodiment. Note that, as for the binding unit of the second embodiment, the same configurations as the binding unit of the first embodiment are denoted with the same reference signs, and the detailed descriptions thereof are omitted.

A binding unit 7B includes an encoder 101 attached to the sleeve 71, and a sensor 102 configured to detect the encoder 101. The encoder 101 is an example of the rotation direction position detection unit, is attached to the outer periphery of the sleeve 71, and has slits 101*a* aligned in the rotation direction of the sleeve 71.

The sensor 102 is an example of the rotation direction position detection unit, includes a pair of optical sensors consisting of light receiving/emitting elements, for example, is configured to move in the axis direction together with the sleeve 71 and is attached to a position at which the slits 101*a* of the encoder 101 can be detected by the movable member 83 that cannot rotate.

Figure 6:
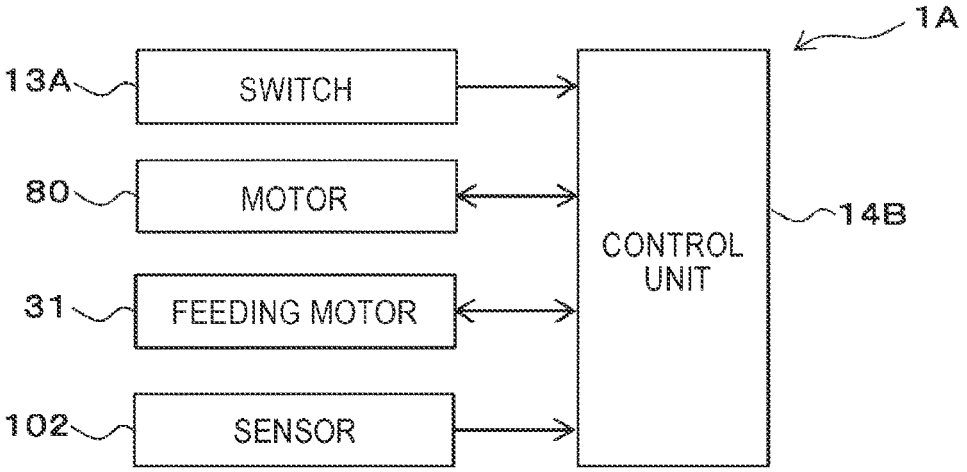
FIG. 6 is a block diagram depicting an example of a control function of the second embodiment of the reinforcing bar binding machine.

FIG. 6 is a block diagram depicting an example of a control function of the second embodiment of the reinforcing bar binding machine. In the reinforcing bar binding machine 1A, a control unit 14B is configured to control the motor 80 and the feeding motor 31 configured to drive the feeding gears 30, according to a state of the switch 13A that is pushed by an operation of the trigger 12A shown in FIG. 1.

When the control unit 14B detects a load applied to the motor 80 and detects that the load reaches the maximum, the control unit 14B calculates the rotation amount of the motor 80 until the rotation of the motor 80 is stopped, based on the rotation amount of the sleeve 71 (wire engaging body 70) detected by the sensor 102. After the maximum load is detected, the motor 80 is rotated by a predetermined amount and the forward rotation of the motor 80 is then stopped.

Example of Operation of Binding Unit of Second Embodiment

Subsequently, operations of binding the reinforcing bars S with the wire W by the binding unit 7B and the drive unit 8A of the second embodiment are described with reference to the drawings. Note that, the operation of feeding the wire W in the forward direction and winding the wire around the reinforcing bars S by the curl forming unit 5A, the operation of engaging the wire W by the wire engaging body 70, the operation of feeding the wire W in the reverse direction and winding the wire on the reinforcing bars S, the operation of cutting the wire W and the operation of twisting the wire W are the same as the operations of the reinforcing bar binding machine 1A.

The wire W is twisted, so that the load applied to the motor 80 increases. When the control unit 14B detects the load applied to the motor 80 and detects that the load reaches the maximum, as the rate of change in the drive torque switches from increment to decrement, the control unit 14B calculates the rotation amount D of the motor 80 until the rotation of the motor 80 is stopped, based on the rotation amount of the sleeve 71 (wire engaging body 70) detected by the sensor 102. The rotation amount D until the rotation of the motor 80 is stopped is the smallest rotation amount until the rotation regulation blade 74*a* is engaged to the rotation regulation claw 74*b* when the wire engaging body 70 is reversely rotated.

After detecting the maximum value of the load applied to the motor 80, the control unit 14B further rotates the motor 80 by the predetermined rotation amount D and then stops the forward rotation of the motor 80.

Thereby, the reverse rotation amount of the wire engaging body 70 is suppressed and the twisted portion of the wire W is suppressed from being loosened. Note that, the encoder 101 may also have a configuration where portions having different light reflectances are alternately aligned instead of the slits 101*a*, and the sensor 102 may be configured by a reflection-type optical sensor. The encoder 101 may also have a configuration where magnets are provided instead of the slits 101*a*, and the sensor 102 may be configured by a magnetic sensor.

Configuration Example of Binding Unit of Third Embodiment

Figure 7A:
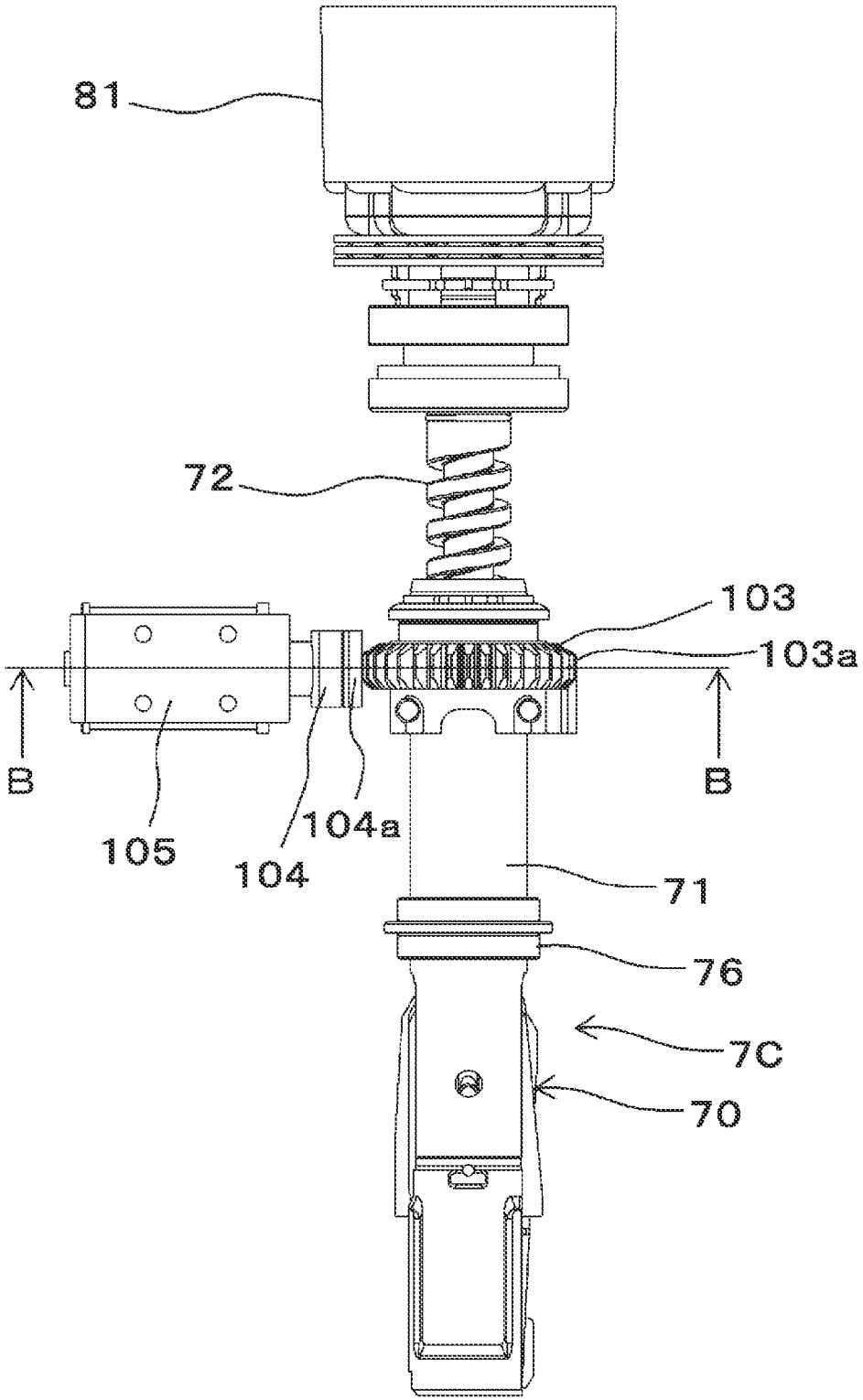
FIG. 7A is a top view depicting an example of a binding unit of a third embodiment.
Figure 7B:
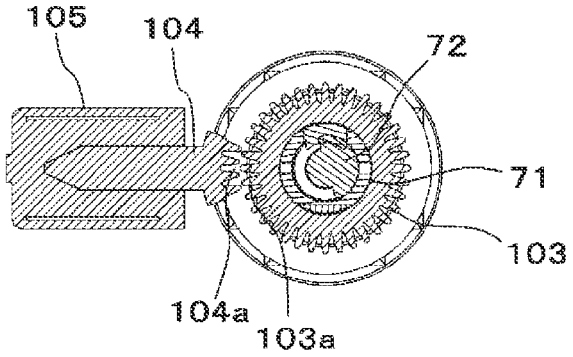
FIG. 7B is a sectional view depicting an example of the binding unit of the third embodiment.

FIG. 7A is a top view depicting an example of a binding unit of a third embodiment, and FIG. 7B is a sectional view taken along a line B-B of FIG. 7A, depicting an example of the binding unit of the third embodiment. Note that, as for the binding unit of the third embodiment, the same configurations as the binding unit of the first embodiment are denoted with the same reference signs, and the detailed descriptions thereof are omitted.

A binding unit 7C includes a checked member 103 attached to the sleeve 71, a check member 104 to be engaged to the checked member 103, and a solenoid 105 configured to drive the check member 104. The checked member 103 is attached to the outer periphery of the sleeve 71, and is provided with unevenness portions 103*a* aligned in the rotation direction of the sleeve 71 and having a spur gear shape. The check member 104 is provided at portions facing the unevenness portions 103*a* of the checked member 103 with unevenness portions 104*a* to be fitted with the unevenness portions 103*a* and having a gear shape. The solenoid 105 is an example of the check member drive unit, and is configured to move the check member 104 in separation/contact directions with respect to the checked member 103 by a coil, a metal core, a spring and the like, which are not shown.

Figure 8:
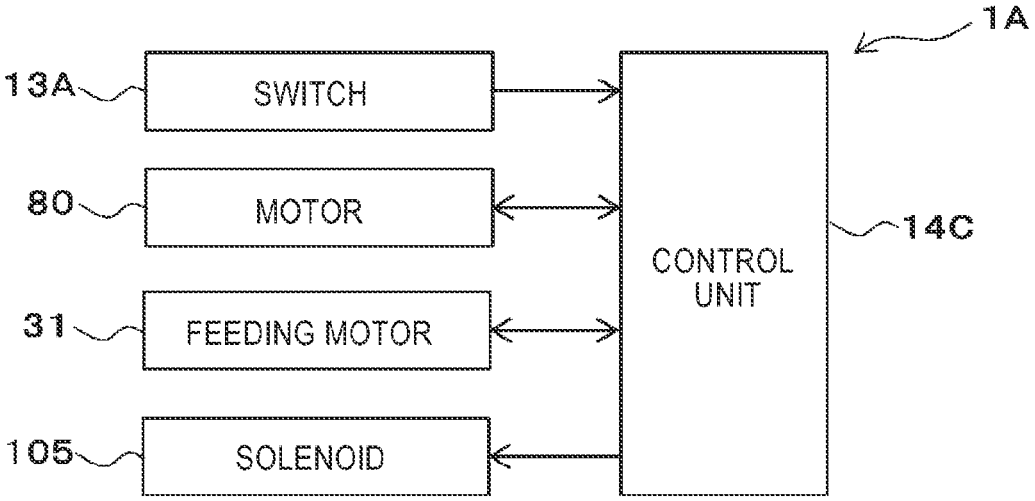
FIG. 8 is a block diagram depicting an example of a control function of the third embodiment of the reinforcing bar binding machine.

FIG. 8 is a block diagram depicting an example of a control function of the third embodiment of the reinforcing bar binding machine. In the reinforcing bar binding machine 1A, a control unit 14C is configured to control the motor 80 and the feeding motor 31 configured to drive the feeding gears 30, according to a state of the switch 13A that is pushed by an operation of the trigger 12A shown in FIG. 1.

When the control unit 14C detects a load applied to the motor 80 and detects that the load reaches the maximum, the control unit 14C stops the forward rotation of the motor 80, and drives the solenoid 105 to cause the unevenness portions 104*a* of the check member 104 to engage with the unevenness portions 103*a* of the checked member 103.

Example of Operation of Binding Unit of Third Embodiment

Subsequently, operations of binding the reinforcing bars S with the wire W by the binding unit 7C and the drive unit 8A of the third embodiment are described with reference to the drawings. Note that, the operation of feeding the wire W in the forward direction and winding the wire around the reinforcing bars S by the curl forming unit 5A, the operation of engaging the wire W by the wire engaging body 70, the operation of feeding the wire W in the reverse direction and winding the wire on the reinforcing bars S, the operation of cutting the wire W and the operation of twisting the wire W are the same as the operations of the reinforcing bar binding machine 1A.

The wire W is twisted, so that the load applied to the motor 80 increases. When the control unit 14C detects the load applied to the motor 80 and detects that the load reaches the maximum, as the rate of change in the drive torque switches from increment to decrement, the control unit 14C stops the forward rotation of the motor 80, and drives the solenoid 105 to cause the unevenness portions 104*a* of the check member 104 to engage with the unevenness portions 103*a* of the checked member 103.

Since the unevenness portions 103*a* of the checked member 103 have a spur gear shape, it is possible to reduce intervals of the unevenness, as compared to intervals of the rotation regulation blades of the related art. As for the unevenness portions 104*a* of the check member 104, the check member 104 is driven by the solenoid 105, so that the unevenness portions 104*a* are fitted with the unevenness portions 103*a* of the checked member 103 and the engaging and disengaging can be made by reciprocal movement of the check member 104.

Thereby, the rotation of the sleeve 71 (wire engaging body 70) is regulated at a timing at which the rotation of the motor 80 is stopped, so that the reverse rotation amount of the wire engaging body 70 is suppressed and the twisted portion of the wire W is suppressed from being loosened.

Configuration Example of Binding Unit of Fourth Embodiment

Figure 9A:
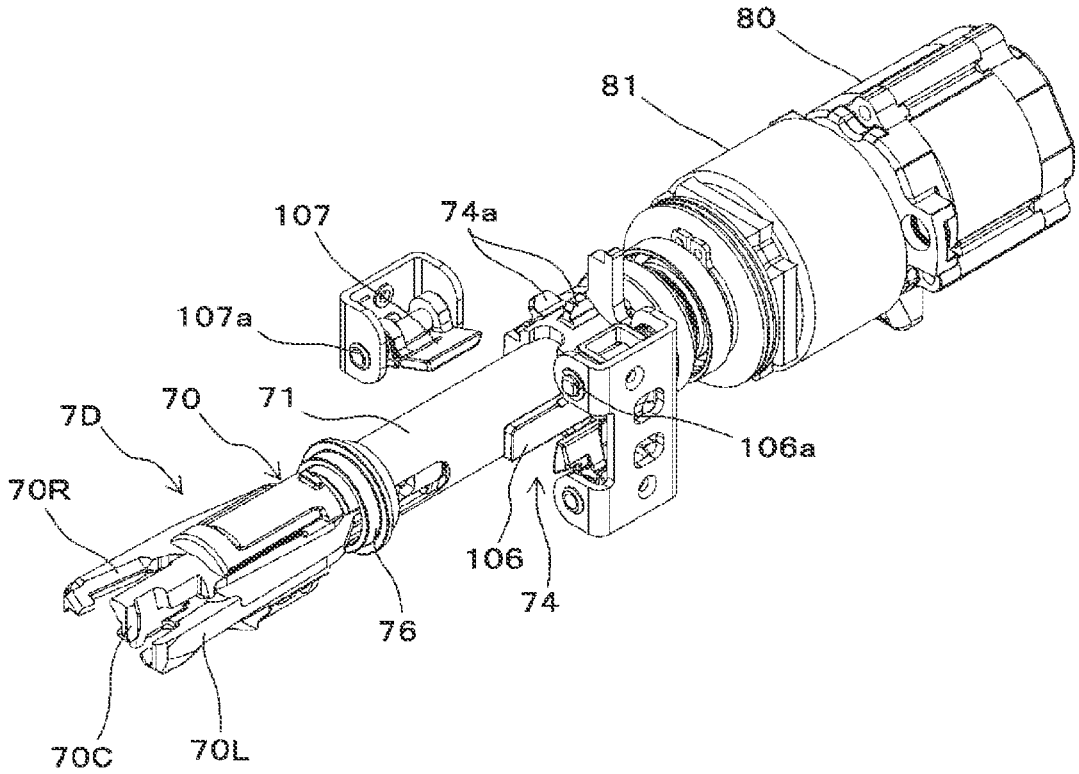
FIG. 9A is a perspective view depicting an example of a binding unit of a fourth embodiment.
Figure 9B:
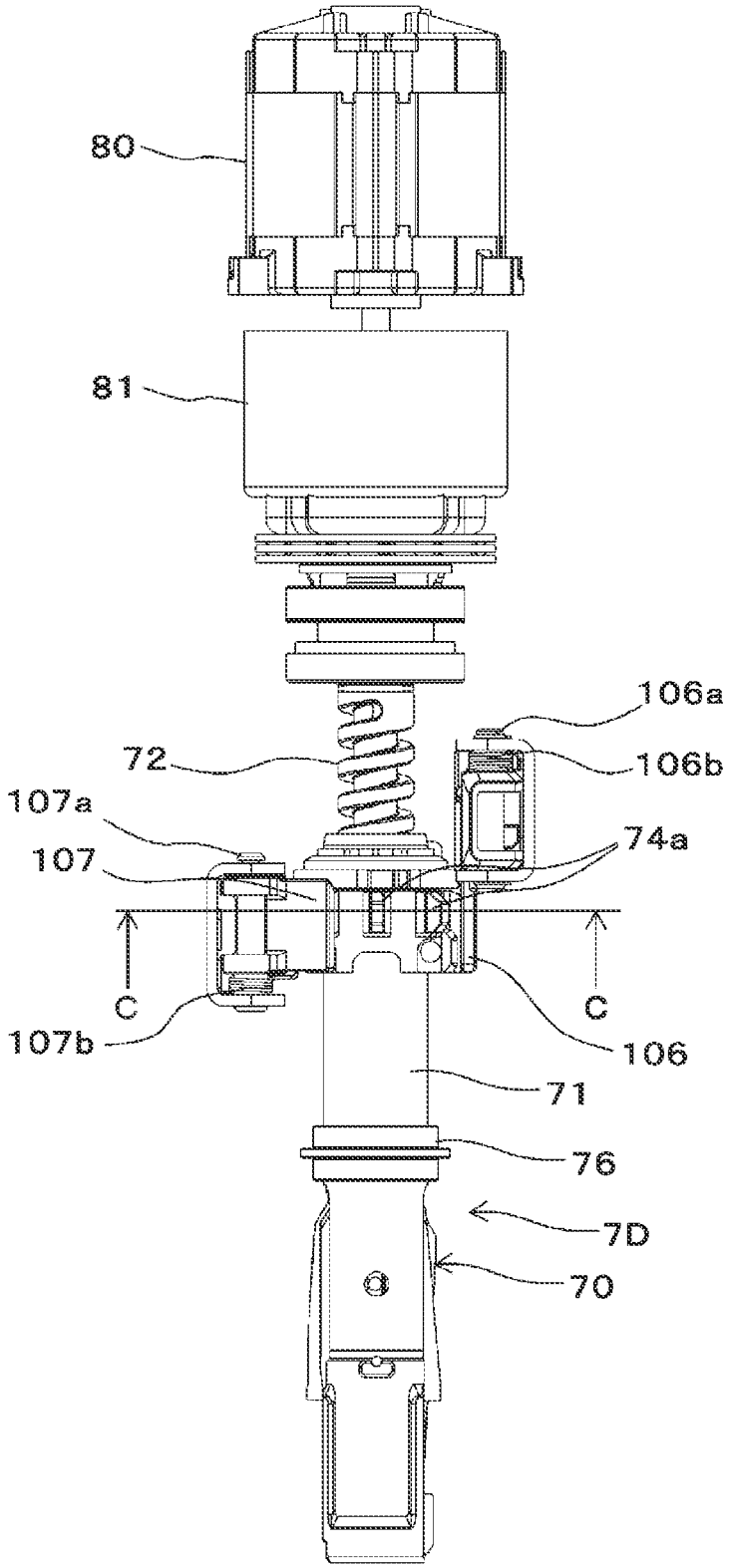
FIG. 9B is a top view depicting an example of the binding unit of the fourth embodiment.

FIG. 9A is a perspective view depicting an example of a binding unit of a fourth embodiment, and FIG. 9B is a top view depicting an example of the binding unit of the fourth embodiment. Note that, as for the binding unit of the fourth embodiment, the same configurations as the binding unit of the first embodiment are denoted with the same reference signs, and the detailed descriptions thereof are omitted.

A binding unit 7D includes a rotation regulation part 74 configured to regulate rotations of the wire engaging body 70 and the sleeve 71 in conjunction with the rotating operation of the rotary shaft 72. The rotation regulation part 74 has rotation regulation blades 74*a* provided to the sleeve 71. In addition, the main body part 10A shown in FIG. 1 is provided with a first check member 106 and a second check member 107.

The rotation regulation blades 74*a* are configured by a plurality of convex portions protruding diametrically from the outer periphery of the sleeve 71 and provided with predetermined intervals in a circumferential direction of the sleeve 71. In the present example, the eight rotation regulation blades 74*a* are formed with intervals of 45°. The rotation regulation blades 74*a* are fixed to the sleeve 71 and are moved and rotated integrally with the sleeve 71.

The first check member 106 is engaged to and disengaged from the rotation regulation blades 74*a* by a rotating operation about a shaft 106*a* as a support point, and is urged in a direction of engaging with the rotation regulation blades 74*a* by a spring 106*b*. The first check member 106 is configured so that it is pushed by the rotation regulation blades 74*a* rotating in one direction (a direction of the arrow F10), which is a direction of twisting the wire W, and can be thus retreated from a locus of the rotation regulation blades 74*a* by the rotating operation about the shaft 106*a* as a support point and it can be engaged with the rotation regulation blades 74*a* rotating in the other direction (a direction of the arrow R10) opposite to the one direction.

The second check member 107 is engaged to and disengaged from the rotation regulation blades 74*a* by a rotating operation about a shaft 107*a* as a support point, and is urged in a direction of engaging with the rotation regulation blades 74*a* by a spring 107*b*. The second check member 107 is configured so that it is pushed by the rotation regulation blades 74*a* rotating in one direction (a direction of the arrow F10), which is a direction of twisting the wire W, and can be thus retreated from the locus of the rotation regulation blades 74*a* by the rotating operation about the shaft 107*a* as a support point and it can be engaged with the rotation regulation blades 74*a* rotating in the other direction (a direction of the arrow R10) opposite to the one direction.

The first check member 106 and the second check member 107 are provided on both sides with the sleeve 71 being interposed therebetween, and an engaging position with the rotation regulation blade 74*a* by the first check member 106 and an engaging position with the rotation regulation blade 74*a* by the second check member 107 are arranged in the rotation direction of the sleeve 71 (wire engaging body 70) and are offset by a predetermined angle to have a phase difference. In the present example, the engaging position with the rotation regulation blade 74*a* by the first check member 106 and the engaging position with the rotation regulation blade 74*a* by the second check member 107 are offset about by 22.5° that is a half of 45° that is an interval of the rotation regulation blades 74*a* in the rotation direction of the wire engaging body 70.

Thereby, when the sleeve 71 (wire engaging body 70) rotates in the direction of twisting the wire W, the first check member 106 and the second check member 107 are retreated from the locus of the rotation regulation blades 74*a* and do not disturb the rotation of the sleeve 71. In contrast, when the sleeve 71 (wire engaging body 70) intends to rotate in the direction opposite to the direction of twisting the wire W, the first check member 106 and the second check member 107 protrude onto the locus of the rotation regulation blades 74*a*, so that one of the first check member 106 and the second check member 107 is engaged with the rotation regulation blade 74*a* and the rotation of the sleeve 71 in the reverse direction is regulated.

Example of Operation of Binding Unit of Fourth Embodiment

Figure 10A:
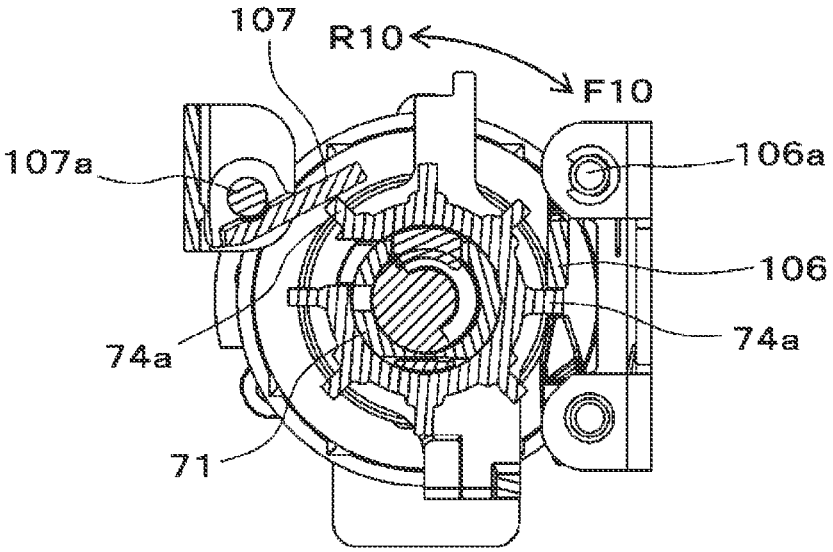
FIG. 10A is a sectional view depicting an example of an operation of the binding unit of the fourth embodiment.
Figure 10B:
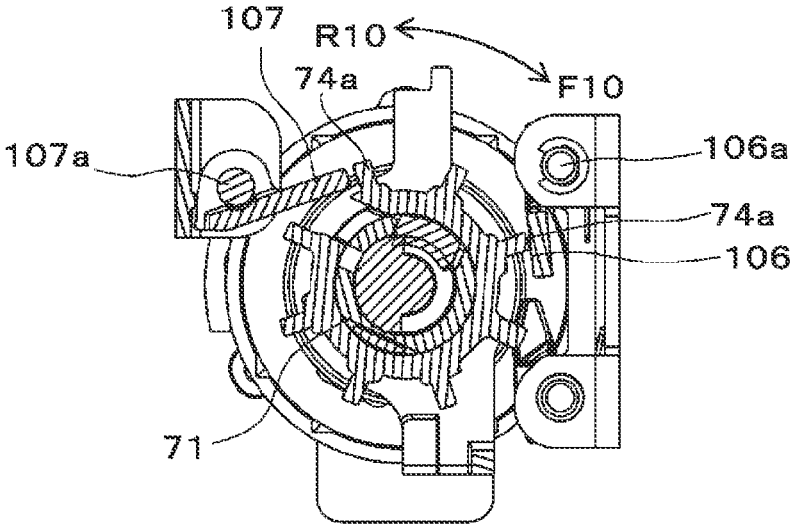
FIG. 10B is a sectional view depicting an example of the operation of the binding unit of the fourth embodiment.

FIGS. 10A and 10B are sectional views taken along a line C-C of FIG. 9B, depicting an example of an operation of the binding unit of the fourth embodiment. Subsequently, operations of binding the reinforcing bars S with the wire W by the binding unit 7D of the fourth embodiment are described with reference to the drawings. Note that, the operation of feeding the wire W in the forward direction and winding the wire around the reinforcing bars S by the curl forming unit 5A, the operation of engaging the wire W by the wire engaging body 70, the operation of feeding the wire W in the reverse direction and winding the wire on the reinforcing bars S, the operation of cutting the wire W and the operation of twisting the wire W are the same as the operations of the reinforcing bar binding machine 1A.

The wire W is twisted, so that the load applied to the motor 80 shown in FIG. 1 and the like increases. When it is detected that the load applied to the motor 80 reaches the maximum, the forward rotation of the motor 80 is stopped. When the forward rotation of the motor 80 is stopped and the force of reversely rotating the wire engaging body 70 is applied to the wire engaging body 70 as the motor 80 is reversely rotated, the wire engaging body 70 is reversely rotated up to the position at which the rotation regulation blade 74*a* is engaged with the first check member 106 or the second check member 107.

The reverse rotation amount of the wire engaging body 70 is, at the stage when the forward rotation of the motor 80 is stopped, a shorter one of a distance between the rotation regulation blade 74*a* and the engaging position with the rotation regulation blade 74*a* by the first check member 106 or a distance between the rotation regulation blade 74*a* and the engaging position with the rotation regulation blade 74*a* by the second check member 107, and is equal to or smaller than the half of the interval of the rotation regulation blades 74*a*, and in the present example, is equal to or smaller than 22.5°.

Thereby, the reverse rotation amount of the wire engaging body 70 is suppressed, so that the twisted portion of the wire W is suppressed from being loosened.

Configuration Example of Binding Unit of Fifth Embodiment

Figure 11:
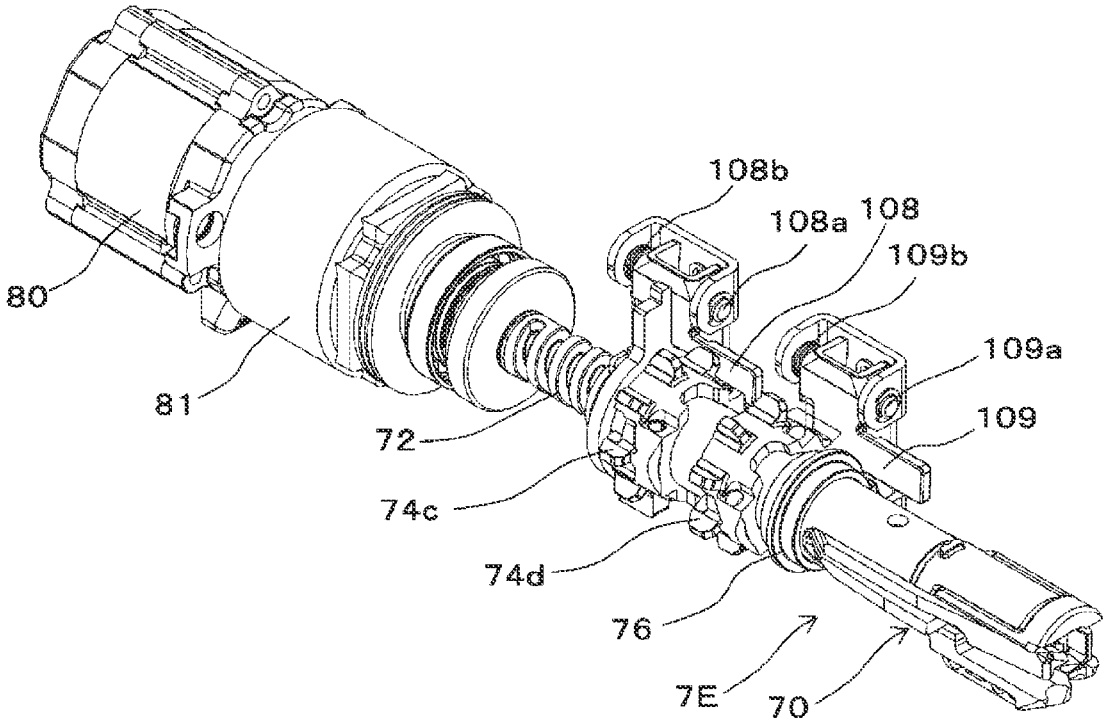
FIG. 11 is a perspective view depicting an example of a binding unit of a fifth embodiment.

FIG. 11 is a perspective view depicting an example of a binding unit of a fifth embodiment. Note that, as for the binding unit of the fifth embodiment, the same configurations as the binding unit of the first embodiment are denoted with the same reference signs, and the detailed descriptions thereof are omitted.

A binding unit 7E includes a rotation regulation part 74 configured to regulate rotations of the wire engaging body 70 and the sleeve 71 in conjunction with the rotating operation of the rotary shaft 72. The rotation regulation part 74 has first rotation regulation blades 74*c* and second rotation regulation blades 74*d* provided to the sleeve 71. In addition, the main body part 10A shown in FIG. 1 is provided with a first check member 108 and a second check member 109.

The first rotation regulation blades 74*c* are configured by a plurality of convex portions protruding diametrically from the outer periphery of the sleeve 71 and provided with predetermined intervals in the circumferential direction of the sleeve 71. In the present example, the eight first rotation regulation blades 74*c* are formed with intervals of 45°. The first rotation regulation blades 74*c* are fixed to the sleeve 71 and are moved and rotated integrally with the sleeve 71.

The second rotation regulation blades 74*d* are configured by a plurality of convex portions protruding diametrically from the outer periphery of the sleeve 71 and provided with predetermined intervals in the circumferential direction of the sleeve 71. In the present example, the eight second rotation regulation blades 74*d* are formed with intervals of 45°. The second rotation regulation blades 74*d* are fixed to the sleeve 71 and are moved and rotated integrally with the sleeve 71.

The first rotation regulation blades 74*c* and the second rotation regulation blades 74*d* have a phase difference in the rotation direction of the sleeve 71 (wire engaging body 70) and are provided at positions offset about by 22.5° that is a half of 45° that is an interval of the respective rotation regulation blades.

The first check member 108 is engaged to and disengaged from the first rotation regulation blades 74*c* by a rotating operation about a shaft 108*a* as a support point, and is urged in a direction of engaging with the first rotation regulation blades 74*c* by a spring 108*b*. The first check member 108 is configured so that it is pushed by the first rotation regulation blades 74*c* rotating in a direction of twisting the wire W and can be thus retreated from a locus of the first rotation regulation blades 74*c* by the rotating operation about the shaft 108*a* as a support point and it can be engaged with the first rotation regulation blades 74*a* rotating in a direction opposite to the direction of twisting the wire W.

The second check member 109 is engaged to and disengaged from the second rotation regulation blades 74*d* by a rotating operation about a shaft 109*a* as a support point, and is urged in a direction of engaging with the second rotation regulation blades 74*d* by a spring 109*b*. The second check member 109 is configured so that it is pushed by the second rotation regulation blades 74*d* rotating in the direction of twisting the wire W and can be thus retreated from a locus of the second rotation regulation blades 74*d* by the rotating operation about the shaft 109*a* as a support point and it can be engaged with the second rotation regulation blades 74*d* rotating in the direction opposite to the direction of twisting the wire W.

Thereby, when the sleeve 71 (wire engaging body 70) rotates in the direction of twisting the wire W, the first check member 108 is retreated from the locus of the first rotation regulation blades 74*c* and does not disturb the rotation of the sleeve 71. In addition, when the sleeve 71 (wire engaging body 70) rotates in the direction of twisting the wire W, the second check member 109 is retreated from the locus of the second rotation regulation blades 74*d* and does not disturb the rotation of the sleeve 71.

In contrast, when the sleeve 71 (wire engaging body 70) intends to rotate in the direction opposite to the direction of twisting the wire W, the first check member 108 protrudes onto the locus of the first rotation regulation blades 74*c*, so that the first check member 108 is engaged with the first rotation regulation blade 74*c* and the rotation of the sleeve 71 in the reverse direction is regulated.

In addition, when the sleeve 71 (wire engaging body 70) intends to rotate in the direction opposite to the direction of twisting the wire W, the second check member 109 protrudes onto the locus of the second rotation regulation blades 74*d*, so that the second check member 109 is engaged with the second rotation regulation blade 74*d* and the rotation of the sleeve 71 in the reverse direction is regulated.

The engaging position with the first rotation regulation blade 74*c* by the first check member 108 and the engaging position with the second rotation regulation blade 74*d* by the second check member 109 are offset about by 22.5°, which is a half of 45° that is an interval of the rotation regulation blades 74*a*, with respect to the rotation direction of the sleeve 71. Thereby, the rotation amount of the sleeve 71 (wire engaging body 70) that can rotate in the reverse rotation direction is a half of the interval of the respective rotation regulation blades.

Example of Operation of Binding Unit of Fifth Embodiment

Subsequently, operations of binding the reinforcing bars S with the wire W by the binding unit 7E of the fourth embodiment are described with reference to the drawings. Note that, the operation of feeding the wire W in the forward direction and winding the wire around the reinforcing bars S by the curl forming unit 5A, the operation of engaging the wire W by the wire engaging body 70, the operation of feeding the wire W in the reverse direction and winding the wire on the reinforcing bars S, the operation of cutting the wire W and the operation of twisting the wire W are the same as the operations of the reinforcing bar binding machine 1A.

The wire W is twisted, so that the load applied to the motor 80 shown in FIG. 1 and the like increases. When it is detected that the load applied to the motor 80 reaches the maximum, the forward rotation of the motor 80 is stopped. When the forward rotation of the motor 80 is stopped and the force of reversely rotating the wire engaging body 70 is applied to the wire engaging body 70 as the motor 80 is reversely rotated, the wire engaging body 70 is reversely rotated up to the position at which the first rotation regulation blade 74*c* is engaged to the first check member 108 or up to the position at which the second rotation regulation blade 74*d* is engaged to the second check member 109.

The reverse rotation amount of the wire engaging body 70 is, at the stage when the forward rotation of the motor 80 is stopped, a shorter one of a distance between the first rotation regulation blade 74*c* and the engaging position with the first rotation regulation blade 74*c* by the first check member 108 or a distance between the second rotation regulation blade 74*d* and the engaging position with the second rotation regulation blade 74*d* by the second check member 109, and is equal to or smaller than the half of the interval between the rotation regulation blades 74*a*, and in the present example, is equal to or smaller than 22.5°.

Thereby, the reverse rotation amount of the wire engaging body 70 is suppressed, so that the twisted portion of the wire W is suppressed from being loosened.

What is claimed is:

1. A binding machine comprising:

a wire feeding unit configured to feed a wire;

a curl forming unit configured to form a path along which the wire fed by the wire feeding unit is to be wound around a to-be-bound object;

a cutting unit configured to cut the wire wound on the to-be-bound object;

a binding unit configured to twist the wire wound on the to-be-bound object;

a motor configured to drive the binding unit; and a control unit configured to control the motor, wherein the binding unit comprises:

a rotary shaft to be driven by the motor;

a wire engaging body configured to engage the wire and to rotate together with the rotary shaft, thereby twisting the wire; and a rotation regulation part configured to regulate rotation of the wire engaging body, and wherein the control unit is configured to calculate a rotation amount of the motor to control stop of the motor rotating in a direction of twisting the wire, wherein the rotation amount is calculated as a smallest rotation amount from a position in a rotation direction of the wire engaging body to a position at which the rotation of the wire engaging body can be regulated by the rotation regulation part.

2. The binding machine according to claim 1, further comprising a rotation direction position detection unit configured to detect the position in the rotation direction of the wire engaging body, wherein the control unit is configured to control the stop of the motor rotating in the direction of twisting the wire, based on the position in the rotation direction of the wire engaging body detected by the rotation direction position detection unit.

3. A binding machine comprising:

a wire feeding unit configured to feed a wire;

a curl forming unit configured to form a path along which the wire fed by the wire feeding unit is to be wound around a to-be-bound object;

a cutting unit configured to cut the wire wound on the to-be-bound object;

a binding unit configured to twist the wire wound on the to-be-bound object;

a motor configured to drive the binding unit; and a control unit configured to control the motor, wherein the binding unit comprises:

a rotary shaft to be driven by the motor;

a wire engaging body configured to engage the wire and to rotate together with the rotary shaft, thereby twisting the wire;

a check member configured to engage with the wire engaging body and to regulate rotation of the wire engaging body; and a check member drive unit configured to drive the check member, and wherein when it is determined to stop the motor rotating in a direction of twisting the wire, the control unit stops the motor, and controls the check member drive unit to cause the check member to engage with the wire engaging body.

4. The binding machine according to claim 3, wherein the check member and the wire engaging body are engaged by uneven portions provided on the check member and the wire engaging body.

5. A binding machine comprising:

a wire feeding unit configured to feed a wire;

a curl forming unit configured to form a path along which the wire fed by the wire feeding unit is to be wound around a to-be-bound object;

a cutting unit configured to cut the wire wound on the to-be-bound object; and a binding unit configured to be driven by a motor and to twist the wire wound on the to-be-bound object, wherein the binding unit comprises:

a rotary shaft to be driven by the motor;

a wire engaging body configured to engage the wire and to rotate together with the rotary shaft, thereby twisting the wire; and a rotation regulation part configured to regulate rotation of the wire engaging body, wherein the rotation regulation part comprises:

a plurality of rotation regulation blades aligned in a rotation direction of the wire engaging body; and a plurality of check members configured to not disturb rotation of the wire engaging body when the wire engaging body rotates in a direction of twisting the wire and to be engaged to the rotation regulation blades to prevent rotation of the wire engaging body when the wire engaging body rotates in a direction opposite to the direction, and wherein engaging positions where the check members are engaged to the rotation regulation blades are arranged in the rotation direction of the wire engaging body.

6. The binding machine according to claim 5, wherein one of the plurality of rotation regulation blades and the plurality of check members are provided with a phase difference in the rotation direction of the wire engaging body.

7. The binding machine according to claim 6, wherein the plurality of check members are provided with a phase difference in the rotation direction of the wire engaging body.

8. The binding machine according to claim 6, wherein the plurality of rotation regulation blades provided in an axis direction of the wire engaging body are provided with a phase difference in the rotation direction of the wire engaging body.

* * * * *